US009115541B2

(12) United States Patent
Li et al.

(10) Patent No.: US 9,115,541 B2
(45) Date of Patent: Aug. 25, 2015

(54) IMPULSE-TYPE UNDERGROUND SUPERCHARGED JET DRILLING METHOD AND DEVICE

(71) Applicant: College of Petroleum Engineering, China University of Petroleum—Beijing (CUPB), Changping District, Beijing (CN)

(72) Inventors: Gensheng Li, Beijing (CN); Jilei Niu, Shandong (CN); Zhongwei Huang, Beijing (CN); Huaizhong Shi, Beijing (CN); Shouceng Tian, Beijing (CN); Jiasheng Fu, Beijing (CN)

(73) Assignee: China University of Petroleum-Beijing (CUPB), Changping District, Beijing (CN)

( * ) Notice: Subject to any disclaimer, the term of this patent is extended or adjusted under 35 U.S.C. 154(b) by 351 days.

(21) Appl. No.: 13/683,426

(22) Filed: Nov. 21, 2012

(65) Prior Publication Data

US 2013/0199849 A1 Aug. 8, 2013

(30) Foreign Application Priority Data

Feb. 8, 2012 (CN) ..... 2012 1 0027666

(51) Int. Cl.
*E21B 7/18* (2006.01)
*E21B 4/00* (2006.01)
*E21B 7/24* (2006.01)

(52) U.S. Cl.
CPC . *E21B 7/18* (2013.01); *E21B 4/006* (2013.01); *E21B 7/24* (2013.01)

(58) Field of Classification Search
CPC ..... E21B 7/18; E21B 7/24; E21B 10/61; E21B 21/10; E21B 21/12
USPC ..... 175/67, 424
See application file for complete search history.

(56) References Cited

U.S. PATENT DOCUMENTS 3,897,836 A * 8/1975 Hall et al. ..... 175/93
4,633,958 A * 1/1987 Mouton ..... 175/65

(Continued)

FOREIGN PATENT DOCUMENTS

CN 1099456 A 3/1995
CN 2642983 Y 9/2004

(Continued)

OTHER PUBLICATIONS

Chinese Office Action dated Jul. 1, 2013 corresponding to Chinese Patent App. No. 2012002666.7, 11 pp.

*Primary Examiner* — Jennifer H Gay
(74) *Attorney, Agent, or Firm* — Ohlandt, Greeley, Ruggiero & Perle, L.L.P.

(57) ABSTRACT

An impulse-type underground supercharged jet drilling method and device. The impulse-type underground supercharged jet drilling method uses up and down vibrations of a drill string or weight on bit variation during the drilling process, so that an upper joint connected to the drill string drives a housing and a supercharging cylinder block to move up and down relative to a supercharging piston, while the supercharging piston, a high pressure line, and a drive shaft disposed outside the high pressure line make a reciprocally retractable movement relative to the housing. As a result, some working fluid entering the supercharging cylinder block is intermittently supercharged, and discharged from a high pressure fluid passage disposed in the supercharging piston and the high pressure line. The device effectively imparts an underground supercharging to parts of the drilling fluid, thus improving the rock breaking efficiency and the drilling speed.

12 Claims, 7 Drawing Sheets

(56) References Cited

U.S. PATENT DOCUMENTS

| | | | | |
|---|---|---|---|---|
| 5,429,036 | A * | 7/1995 | Latos | 91/181 |
| 5,787,998 | A * | 8/1998 | O'Hanlon et al. | 175/67 |
| 6,073,708 | A * | 6/2000 | Brown et al. | 175/93 |
| 6,289,998 | B1 * | 9/2001 | Krueger et al. | 175/25 |
| 7,594,551 | B1 * | 9/2009 | Mouton | 175/57 |
| 2008/0271923 | A1 * | 11/2008 | Kusko et al. | 175/25 |
| 2013/0199849 | A1 * | 8/2013 | Li et al. | 175/57 |
| 2014/0166368 | A1 * | 6/2014 | Guan et al. | 175/67 |

FOREIGN PATENT DOCUMENTS

| | | | |
|---|---|---|---|
| CN | 2685528 | Y | 3/2005 |
| CN | 2821204 | Y | 9/2006 |
| CN | 201232614 | Y | 5/2009 |
| CN | 201265360 | Y | 7/2009 |
| CN | 101705789 | A | 5/2010 |
| CN | 201627541 | U | 11/2010 |
| EP | 1396585 | A1 | 3/2004 |
| WO | 2010017139 | A2 | 2/2010 |

* cited by examiner

IMPULSE-TYPE UNDERGROUND SUPERCHARGED JET DRILLING METHOD AND DEVICE

FIELD OF THE INVENTION

The present invention relates to a hydraulic jet drilling device, and particularly, to an impulse-type underground supercharged jet drilling method and device, which breaks rocks and drills holes by using the vibrations generated during the drilling process.

BACKGROUND OF THE INVENTION

With the extension of the borehole in the drilling process, the rocks need to be continuously broken, and usually for a distance of several kilometers. However, with the increase of the well depth, the difficulty of rock breaking increases while the efficiency of rock breaking decreases. The conventional rock breaking methods mainly include the mechanical method and the jet hydraulic one, and the latter requires very high jet pressure.

Under the current drilling conditions, the jet only has an auxiliary function of hydraulic rock breaking. When the jet pressure is increasing, the effect of hydraulic auxiliary rock breaking will be improved, and even rocks may be directly broken in a hydraulic manner. In order to directly break rocks in a hydraulic manner, the jet pressure shall exceed the threshold pressure of rock breaking. There are two methods for increasing the drilling fluid pressure. One method uses the surface supercharging, which improves the downhole jet velocity by increasing the volume of the surface pumped high pressure drilling fluid. But practices have shown that this method is unfeasible due to low efficiency, high cost and insecurity. Since the impulse jet usually has a stronger rock breaking capability than the conventional continuous jet under the same pressure, another underground supercharging method has been proposed. Although various underground superchargers emerges in china and other countries, they all have certain defects, such as complex structure, low reliability, low efficiency, or the supercharging is not enough. For example, the Chinese patent No. 93116601.2 discloses an "automatic supercharging device", which controls the direction change and activates supercharge by using a combination of the motor pilot valve and the hydraulic changeover valve. However, the defects of the device include challenges in direction control and short seal life. The Chinese patent No. 200520103214.8 discloses a "fluid supercharger", which supercharges by using an underground plunger, while the seal life is always not well prolonged and the supercharging effect is poor. The Chinese patent No. 200820019505.2 discloses "underground booster pump using positive displacement motor with double helical grooves", which uses a positive displacement motor to drive a plunger to change directions through the double helical grooves, but the fluid passage is too small due to the large volume of the helical grooves, thus the erosion is serious. The Chinese patent No. 201020125587.2 discloses an "underground drill string damping and supercharging device", which uses a spring controlled valve to implement reciprocating supercharging, but the spring does cannot guarantee working stably and reliably enough underground, and the supercharged value will be decreased. Therefore, a new underground supercharging device needs to be developed to implement the underground supercharging.

In view of the above defects of the prior art, the inventors develop an impulse-type underground supercharged jet drilling method and device of the present invention based on their years of production and design experiences in related fields for many years, which combines the advantages of both impulse jet drilling and ultrahigh jet drilling, and can greatly improve rock breaking efficiency and drilling speed.

SUMMARY OF THE INVENTION

The object of the present invention is to provide an impulse-type underground supercharged jet drilling method and device by using up and down vibrations of a drill string or weight on bit (WOB) variation, so as to effectively perform underground supercharging to a part of drilling fluid and implement the high pressure jet rock breaking, thereby improving the rock breaking efficiency and the drilling speed.

For this purpose, the present invention provides an impulse-type underground supercharged jet drilling method, which uses up and down vibrations of a drill string or WOB variation during the drilling process, so that an upper joint connected to the drill string drives a housing and a supercharging cylinder block disposed therein to move up and down relative to a supercharging piston, while the supercharging piston, a high pressure line connected thereto and a drive shaft disposed outside the high pressure line make a reciprocally retractable movement relative to the housing, as a result, some working fluid entering the supercharging cylinder block is intermittently supercharged, and discharged from a high pressure fluid passage disposed in the supercharging piston and the high pressure line, the discharged high pressure working fluid forms a high pressure jet through a nozzle, other working fluid enters a drill bit through a normal pressure fluid passage between the housing, the supercharging cylinder block, and the high pressure line, the drive shaft, thereby forming a normal pressure jet.

When the drill string moves upwards due to vibration of the drill string or WOB decrease, under the hydraulic pressure of the working fluid for drilling, the upper joint and the housing drive the supercharging cylinder block to move upwards relative to the supercharging piston, so that the drive shaft protrudes from the housing, at the same time, a negative pressure is produced in the supercharging cylinder block, and the working fluid enters and fully fills the supercharging cylinder block through a one-way intake valve disposed on the supercharging cylinder block; when the drill string moves downwards due to vibration or WOB increase, under an impact force or a large WOB, the upper joint and the housing drive the supercharging cylinder block to move downwards relative to the supercharging piston, so that the drive shaft retracts into the housing, the pressure in the supercharging cylinder block rises and closes the one-way intake valve, and the supercharging cylinder block continues moving downwards, when the hydraulic pressure in the supercharging cylinder block reaches a predetermined value, the supercharged working fluid compels a one-way drainage valve disposed at the lower end of the high pressure line to be opened, enters a high pressure channel embedded in the drill bit, and produces an ultrahigh jet through the nozzle.

The present invention further provides an impulse-type underground supercharged jet drilling device to implement the above method, comprising:

a housing;

a supercharging cylinder which comprises a supercharging cylinder block and a supercharging piston, wherein the supercharging cylinder block is disposed inside the housing and connected to one end thereof, a first normal pressure fluid passage is formed between the supercharging cylinder block and the housing, one end of the supercharging cylinder block is provided with a one-way intake valve, and the other end forms a sliding seal with the supercharging piston;

a drive shaft disposed at the other end of the housing and can only make retractable movements relative to the housing; the supercharging piston is fixedly connected to the drive shaft;

a high pressure line disposed inside the drive shaft with one end connected to the supercharging piston and the other end connected to a high pressure nozzle; the high pressure line and the supercharging piston are both hollow columns, and their hollow portions form high pressure fluid passages communicated with each other; a second normal pressure fluid passage is formed between the high pressure line and the drive shaft and communicated with the first normal pressure fluid passage; at an outlet end of the high pressure fluid passages there is disposed a one-way drainage valve, to which the high pressure nozzle is connected;

wherein the housing is connected to an upper drill tool through an upper joint, one end of the drive shaft protruding outside the housing is fixedly connected to a lower joint, and the lower joint is connected to a drill bit to which the second normal pressure fluid passage is connected.

The present invention has the following advantages and characteristics.

The present invention uses the drill string vibration or the WOB variation as the power source, converts the kinetic energy or potential energy of the drill string into the pressure energy of the fluid, and achieves the effect of rock breaking with the underground supercharging and the ultrahigh pressure jet, thereby improving the mechanical drilling speed and reducing the drilling cost. The basic principle is as follows: when the drill string vibrates up and down or the WOB varies, under an external force, the upper joint and the housing drive the supercharging cylinder block to move up and down relative to the supercharging piston (tool's extension or retraction), thereby intermittently supercharging the working fluid entering the supercharging cylinder block. The variation of the external force or the WOB causes the supercharging piston to move up and down relative to the supercharging cylinder block.

Part of the working fluid for drilling is discontinuously supercharged into the high pressure fluid by using the axial (longitudinal) vibration and the pressure energy of the working fluid for drilling. The high pressure working fluid is sprayed through the independent high pressure nozzle on the drill bit to form a high pressure jet, which is very helpful to improve the deep well drilling speed. The working fluid not supercharged (i.e., the normal pressure working fluid) is sprayed through the ordinary nozzle of the drill bit, so as to perform downhole drill cuttings cleaning and hydraulic auxiliary rock breaking.

The present invention has a feasible principle, a simple and reliable structure, thus can meet the requirements of underground actual usage.

BRIEF DESCRIPTION OF THE DRAWINGS

The following drawings are merely used to schematically illustrate and explain the present invention, rather than limiting the scope of the present invention. In which.

REFERENCES SIGNS

Figure 1:
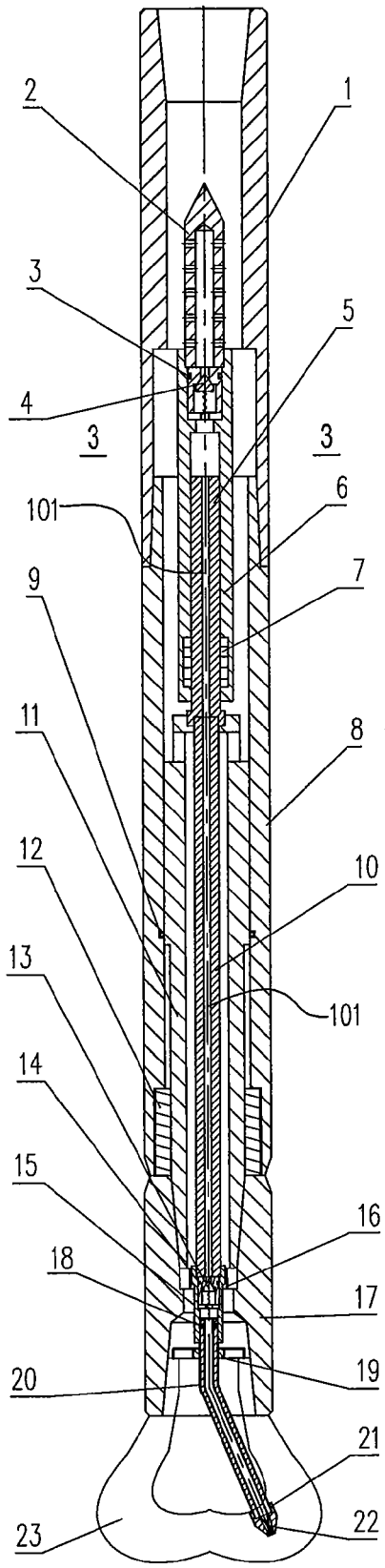
FIG. 1 is a structure diagram of the present invention in a state where the tool moves downwards for fluid supercharging and discharging.

| | | | |
|---|---|---|---|
| 1. | Upper Joint | 100. | Accommodation Cavity |
| 2. | Filter | 3. | First Sealing Element |
| 4. | One-Way Intake Valve | 5. | Supercharging Piston |
| 6. | Supercharging Cylinder Block | 60. | Convex Rib |
| 7. | High Pressure Seal Assembly | 8. | Housing |
| 9. | Second Sealing Element | 10. | High Pressure Line |
| 101. | High Pressure Fluid Passage | 11. | Drive Shaft |
| 110. | Via Hole | 111. | Protrusion End |
| 112. | Support End | 113. | Stop Portion |
| 12. | Drive Retainer | 13. | One-Way Drainage Valve |
| 14. | Third Sealing Element | 15. | High Pressure Joint |
| 16. | Socket | 17. | Lower Joint |
| 18. | Fourth Sealing Member | 19. | Pipe Rack |
| 20. | High Pressure Channel | 21. | Nozzle Cage |
| 22. | High Pressure Nozzle | 23. | Drill Bit |
| 24. | First Normal Pressure Fluid Passage | 25. | Second Normal Pressure Fluid Passage |
| 26. | Third Normal Pressure Fluid Passage | 27. | Fourth Normal Pressure Fluid Passage |

DETAILED DESCRIPTION OF THE PREFERRED EMBODIMENTS

In order to have a more clear understanding about the technical features, objects and effects of the present invention, the structures, features and effects of the impulse-type underground supercharged jet drilling method and device will be detailedly described as follows with reference to the drawings and preferred embodiments. In addition, through the descriptions of the implementation, the technical means adopted to achieve the intended objects of the present invention and the produced effects will be understood more deeply and concretely. However, the drawings just provide references and illustrations, rather than limitations to the present invention. Moreover, in the drawings, the upper direction is the upper end, and the lower direction is the lower end.

Figure 2:
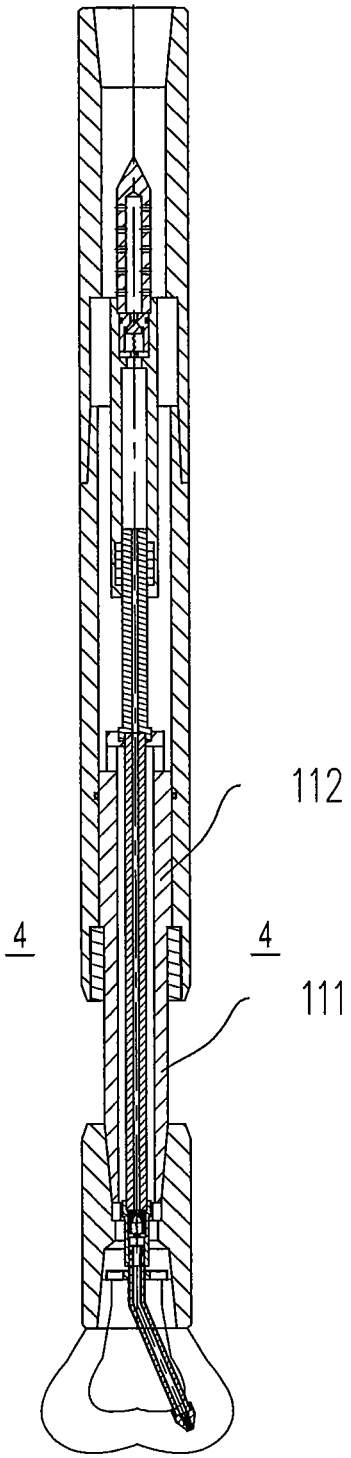
FIG. 2 illustrates a state where the tool moves upwards for fluid absorption.

As illustrated in FIGS. 1 and 2, the impulse-type underground supercharged jet drilling method uses the up and down vibrations of a drill string or the WOB variation during the drilling process, so that an upper joint 1 connected to the drill string drives a housing 8 and a supercharging cylinder block 6 disposed therein to move up and down relative to a supercharging piston 5, while the supercharging piston 5, a high pressure line 10 connected thereto and a drive shaft 11 disposed outside the high pressure line 10 make a reciprocally retractable movement relative to the housing 8. As a result, some working fluid entering the supercharging cylinder block 6 is intermittently supercharged, and discharged from a high pressure fluid passage 101 disposed in the supercharging piston 5 and the high pressure line 10. The discharged high pressure working fluid forms a high pressure jet through a nozzle 22. Other working fluid enters a drill bit 23 through a normal pressure fluid passage between the housing 8, the supercharging cylinder block 6, and the high pressure line 10, the drive shaft 11, thereby forming a normal pressure jet. Through the ultrahigh pressure fluid sprayed by the nozzle 22, the present invention implements an ultrahigh pressure jet drilling, which improves the rock breaking efficiency and the drilling speed. Through the normal pressure jet sprayed by the drill bit 23, the present invention implements the functions of downhole drill cuttings cleaning and hydraulic auxiliary rock breaking.

Further, when the drill string moves upwards due to vibration or WOB decrease, under the hydraulic pressure of the working fluid for drilling, the upper joint 1 and the housing 8 drive the supercharging cylinder block 6 to move upwards relative to the supercharging piston 5, so that the drive shaft 11 protrudes from the housing 8 (tool extension). At the same time, a negative pressure is produced in the supercharging cylinder block 6, and the working fluid enters and fully fills the supercharging cylinder block 6 through a one-way intake valve 4 disposed on the supercharging cylinder block 6. When the drill string moves downwards due to vibration or WOB increase, under the impact force or a large WOB, the upper joint 1 and the housing 8 drive the supercharging cylinder block 6 to move downwards relative to the supercharging piston 5, so that the drive shaft 11 retracts into the housing 8 (tool retraction). The pressure in the supercharging cylinder block 6 rises and shuts down the one-way intake valve 4, and the supercharging cylinder block 6 continues moving downwards. When the hydraulic pressure in the supercharging cylinder block 6 reaches a predetermined value, the supercharged working fluid compels a one-way drainage valve 13 disposed at the lower end of the high pressure line 10 to be opened, enters a high pressure channel 20 embedded in the drill bit 23, and produces an ultrahigh jet through the high pressure nozzle 22.

In addition, the working fluid entering the supercharging cylinder block 6 is less than that entering the normal pressure fluid passage.

In order to implement the above impulse-type underground supercharged jet drilling method, the present invention provides a drilling device, comprising: a housing 8, a supercharging cylinder having a supercharging cylinder block 6 and a supercharging piston 5, a drive shaft 11 and a high pressure line 10. Among which, the supercharging cylinder block 6 is disposed in the housing 8 and connected to one end (upper end) thereof. The outer diameter of the supercharging cylinder block 6 is smaller than the inner diameter of the housing 8, and a first normal pressure fluid passage 24 is formed therebetween. One end (upper end) of the supercharging cylinder block 6 is provided with a one-way intake valve 4, and the other end (lower end) forms a sliding seal with the supercharging piston 5. The drive shaft 11 is disposed at the other end (lower end) of the housing 8, and can only make retractable movement relative to the housing 8. The supercharging piston 5 is fixedly connected to the drive shaft 11. The high pressure line 10 is disposed in the drive shaft 11, with one end (upper end) connected to the lower end of the supercharging piston 5, and the other end (lower end) connected to a high pressure nozzle 22. The high pressure line 10 and the supercharging piston 5 are both hollow columns, and their hollow portions construct the interconnected high pressure fluid passages 101. The outer diameter of the high pressure line 10 is smaller than the inner diameter of the drive shaft 11, and a second normal pressure fluid passage 25 is formed therebetween. The second normal pressure fluid passage is connected to the first normal pressure fluid passage. In addition, at the outlet end of the high pressure fluid passages 101 there is disposed a one-way drainage valve 13, to which the high pressure nozzle 22 is connected. The housing 8 is connected to the upper drill tool through the upper joint 1. One end of the drive shaft 11 protruding outside the housing 8 is fixedly connected to a lower joint 17. The lower joint 17 is connected to a drill bit 23 to which the second normal pressure fluid passage is connected.

In one embodiment, the maximum protrusion distance of the drive shaft 11 is shorter than the effective working stroke of the supercharging piston 5, so as to ensure that the upper end face of the supercharging piston 5 will not contact the supercharging cylinder block 6, when the supercharging piston 5 moves upwards relative to the supercharging cylinder block 6 and the lower end face of the housing 8 contacts the upper end face of the lower joint 17, thereby preventing the supercharging piston 5 and the supercharging cylinder block 6 being damaged by a too much large force, thus prolonging their service lives.

Furthermore, the sidewall at the upper end of the drive shaft 11 has at least one via hole 110, through which the first normal pressure fluid passage 24 and the second normal pressure fluid passage 25 are communicated with each other.

In addition, the drive shaft 11 has a protrusion end 111 capable of protruding outside the housing 8, and a support end 112 slidably connected to the housing 8. A sealed sliding connection structure is formed between the support end 112 and the housing 8.

Figure 4:
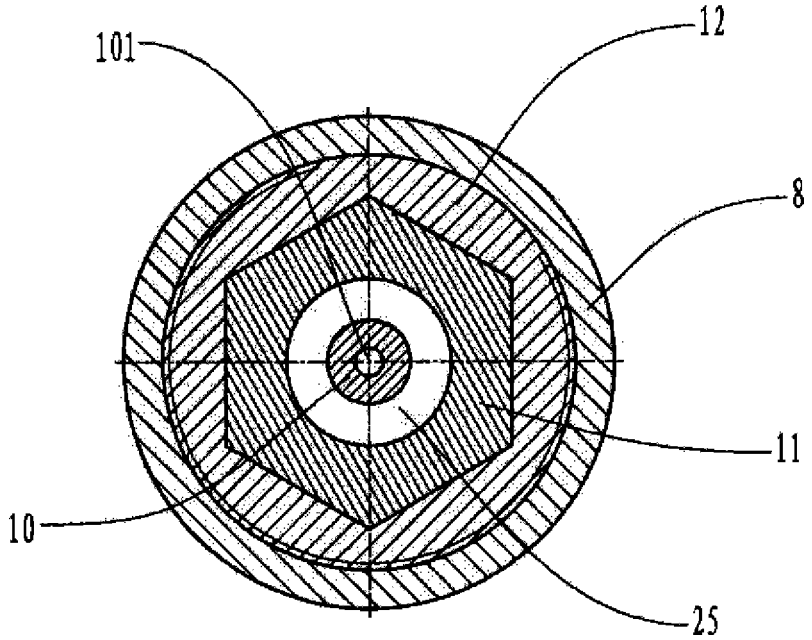
FIG. 4 is a section view along line 4-4 in FIG. 2.

Referring to FIGS. 1 and 4, a preferable technical solution is that a drive retainer 12 is fixed inside the other end (lower end) of the housing 8, and a key connection structure is formed between the drive retainer 12 and the protrusion end of the drive shaft 11.

Figure 7:
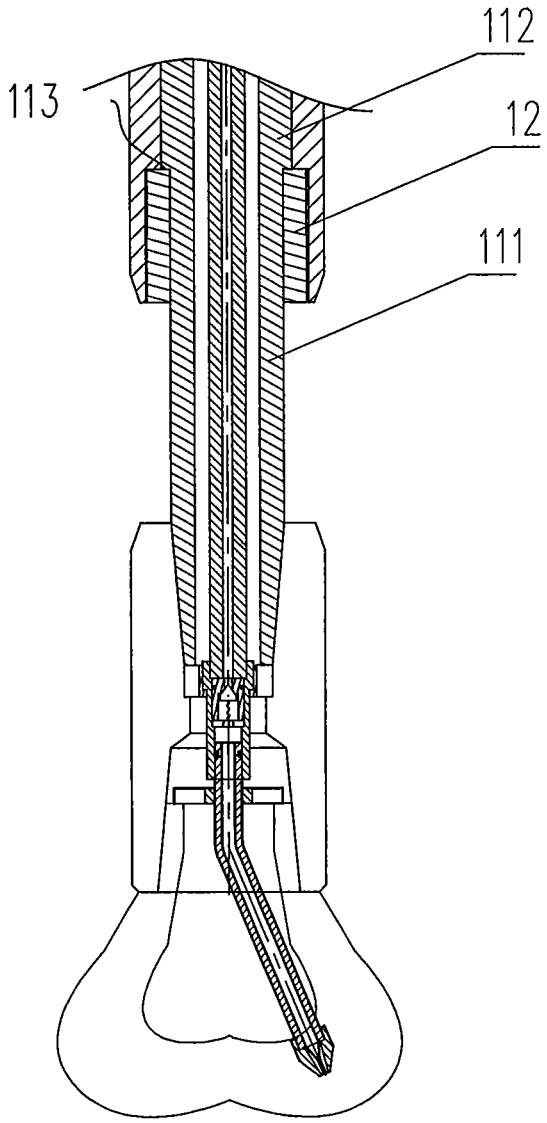
FIG. 7 is a partial enlarged view 3 of FIG. 1.

Further, referring to FIGS. 1 and 7, the inner diameter of the drive retainer 12 is smaller than that of the housing 8, thereby forming a step protruding from the inner wall of the housing. The outer diameter of the protrusion end 111 of the drive shaft 11 is smaller than that of the support end 112, and an annular stop portion 113 is formed between the protrusion end 111 and the support end 112. The stop portion 113 can abut against the step, so as to prevent the supercharging piston 5 from dropping out of the supercharging cylinder block 6.

Figure 5:
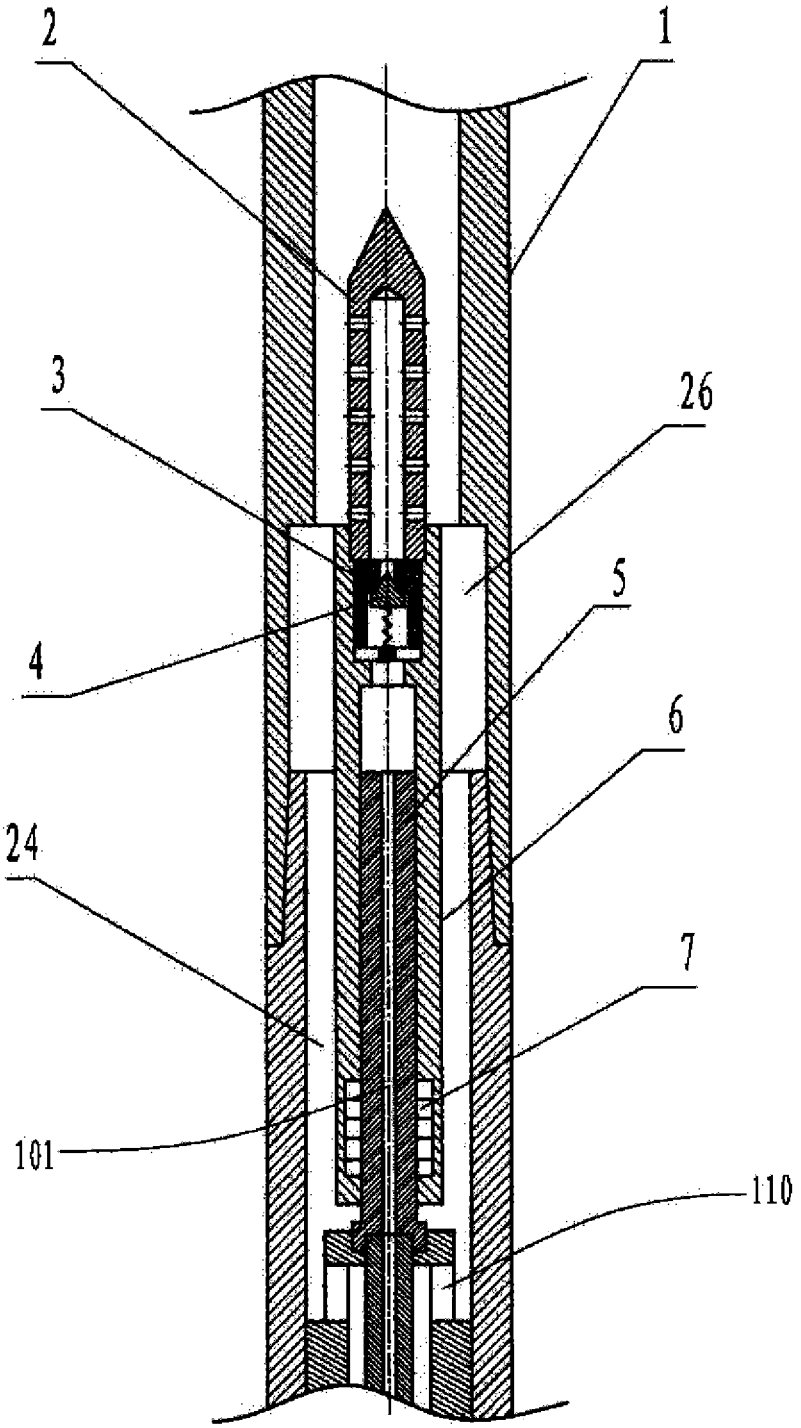
FIG. 5 is a partial enlarged view 1 of FIG. 1.
Figure 8:
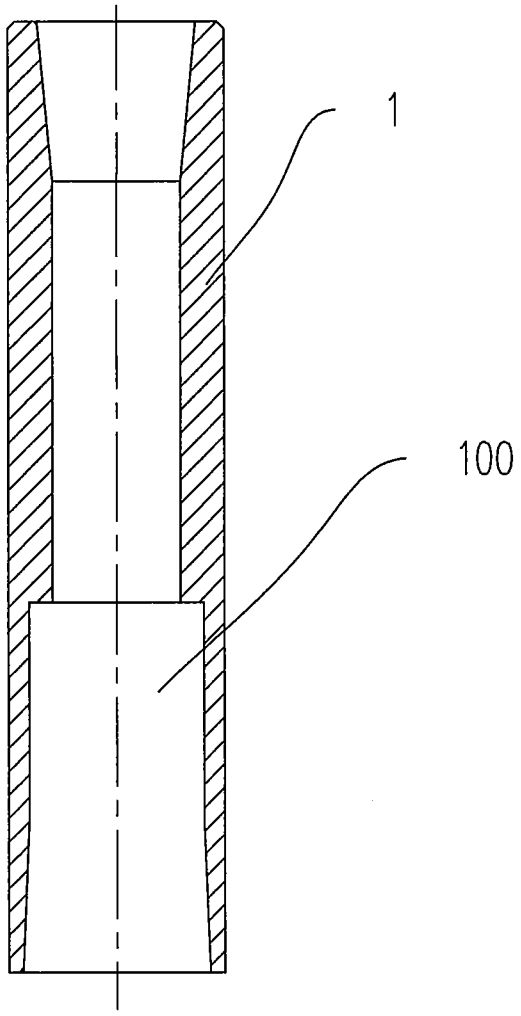
FIG. 8 is a section view of an upper joint.

In one embodiment, referring to FIGS. 1, 5 and 8, a run-through fluid passage is formed inside the upper joint 1, and the fluid passage connected to the housing 8 forms a diameter-enlarged accommodation cavity 100. The supercharging cylinder block 6 has one end protruding outside the housing 8, located inside the accommodation cavity 100 of the upper joint 1, and clamped between the housing and the upper joint. A third normal pressure fluid passage 26 is formed between the supercharging cylinder block 6 and the inner wall of the accommodation cavity 100, and communicated with the first normal pressure fluid passage.

Figure 3:
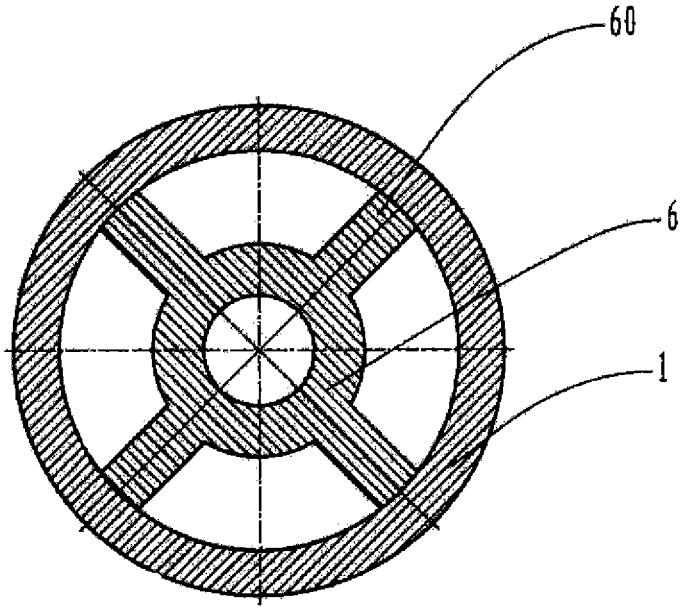
FIG. 3 is a section view along line 3-3 in FIG. 1.

Referring to FIG. 3, the exterior of the supercharging cylinder block 6 located in the accommodation cavity is provided with a plurality of convex ribs 60 in the axial direction. The upper and lower ends of the convex rib 60 abut against tops of the accommodation cavity and the housing, respectively, and the third normal pressure fluid passage is formed between respective ribs. The exterior structure of the supercharging cylinder block 6 is not limited thereto, and it may be any structure in which the supercharging cylinder block 6 is fixed between the upper joint and the housing so that the supercharging cylinder block 6, the upper joint 1 and the housing 8 are fixed together and move as an entirety.

Further, a filter 2 is disposed in the upper joint 1, and formed as a hollow column with the bottom opened. The opening portion is in a threaded connection with one end of the supercharging cylinder block 6. The filter 2 is located in the fluid passage of the upper joint, and its peripheral side is provided with a plurality of inlet holes, so as to filter the working fluid entering the supercharging cylinder block 6.

One preferable solution is that the top of the filter 2 is a tapered closed end, so as to shunt the working fluid entering the supercharging cylinder block 6, and reduce the flow resistance.

Figure 6:
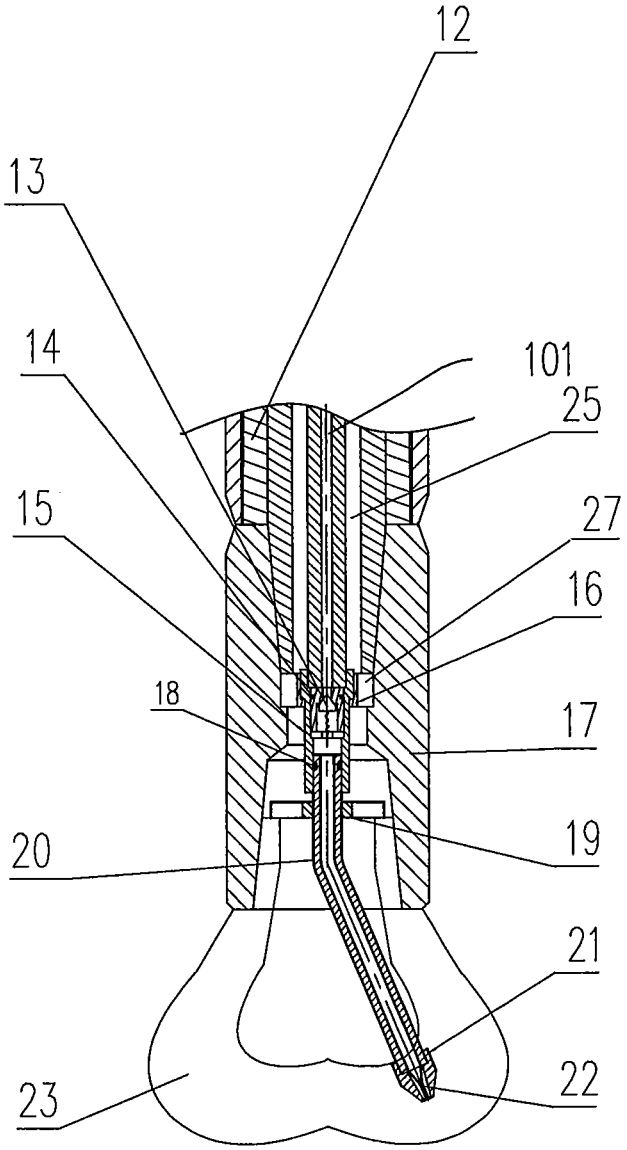
FIG. 6 is a partial enlarged view 2 of FIG. 1.

In addition, referring to FIGS. 1 and 6, in another feasible solution, a socket 16 is disposed at the lower joint 17. A pore channel is opened at the lateral side of the socket 16 to form a fourth normal pressure fluid passage 27 communicated with the second normal pressure fluid passage. The socket 16 has a groove in which a hollow cylindrical high pressure joint 15 is embedded. The one-way drainage valve 13 is disposed in the high pressure joint 15, and its valve core can settle down in the high pressure joint 15 to seal the high pressure fluid passage 101. The lower end of the high pressure joint is connected to the high pressure nozzle 22.

Further, the lower end of the high pressure joint 15 is connected to the high pressure channel 20 embedded in the drill bit 23. The high pressure channel 20 is connected to the high pressure nozzle 22. The high pressure joint 15 is sealed from the high pressure channel 20 through a fourth sealing member 18.

In one embodiment, as illustrated in the drawings, the upper joint 1 and the housing 8 are integrated with each other to serve as a tool enclosure, and they also have the functions of transmitting torque and WOB. The filter 2 is mounted in the upper joint 1, and its lower end is in a threaded connection with the supercharging cylinder block 6. The upper portion of the supercharging cylinder block 6 has a chamber mounted with the one-way intake valve 4 and tightly connected to the lower end of the filter 2. The one-way intake valve 4 has a tapered valve core that seals the fluid passage under the force from a spring disposed at the bottom of the valve core, thereby only allowing the fluid to overcome the spring force at the upper end, pushing aside the valve core and entering the supercharging cylinder block 6, and forbidding the fluid in the supercharging cylinder block 6 to flow oppositely, thus the one-way flow function is realized. The one-way intake valve 4 is sealed from the supercharging cylinder block 6 by a first sealing element 3. The supercharging cylinder block 6 protrudes from the peripheral wall of the housing 8, and is provided with protrusion sections such as the convex ribs 60, by means of which the supercharging cylinder block 6 is limited at the top of the housing 8 and the lower step of the upper joint 1, and can only move with the housing 8 and the upper joint 1 as an entirety, rather than move individually. In addition, the annular space between the supercharging cylinder block 6, the filter 2, and the upper joint 1, the housing 8 forms a normal pressure fluid passage that allows the normal pressure fluid to pass through.

The supercharging piston 5 is fitted in the supercharging cylinder block 6. The supercharging piston 5 is a hollow pipe, and the hollow portion forms a high pressure fluid passage 101. The supercharging cylinder block 6 and the supercharging piston 5 can move up and down relative to each other, and realize the functions of negative pressure liquid absorption and fluid being supercharged. Since the relative movements exists between the supercharging cylinder block 6 and the supercharging piston 5 and high pressure fluid are available, a high pressure seal assembly 7 is designed at a portion on the inner side of the lower end of the supercharging cylinder block 6, which contacts the supercharging piston 5. The lower portion of the supercharging piston 5 is in a threaded connection with the drive shaft 11, and the upper end of the high pressure line 10 is also in a threaded connection with the lower end of the supercharging piston 5. The high pressure line 10 is also hollow and has a high pressure fluid passage 101 the same as that of the supercharging piston 5. These two high pressure fluid passages are communicated with each other and allow the supercharged high pressure fluid to pass through. A hole is opened at the lateral side of the upper portion of the drive shaft 11, and the normal pressure fluid in the above annular space flows from this lateral hole into an annular space between the drive shaft 11 and the high pressure line 10. The drive shaft 11 and the housing 8 are tightly contacted but can make a relative movement with each other, and are sealed by a second sealing element 9. A drive retainer 12 is fixedly mounted on the inner side of the lower end of the housing 8. A spline or keyway connection is designed between the drive retainer 12 and the drive shaft 11, which are relatively movable in the longitudinal direction but not able to move in the circumferential or radial direction. The housing transmits a torque to the drive shaft 11 through the drive retainer 12. The lower end of the drive shaft 11 is in a threaded connection with the lower joint 17. The socket 16 is disposed at the lower end of the drive shaft 11 and the inside of the lower joint 17. Inside the socket 16, there is mounted a high pressure joint 15 in a threaded connection with the lower end of the high pressure line 10. Inside the high pressure joint 15, there is the one-way drainage valve 13 tightly contacted with the high pressure line 10. The tapered valve core in the one-way drainage valve 13 can seal the fluid passage under the force from a spring at the lower portion of the valve core, thereby only allowing the ultrahigh pressure fluid in the high pressure line 10 to push aside the valve core and enter the high pressure joint 15 by overcoming the spring force at the upper end, and forbidding the fluid in the high pressure joint 15 to flow oppositely, thus the one-way valve function is realized. The one-way drainage valve 13 is sealed from the high pressure joint 15 by a third sealing element 14. The upper end of the high pressure channel 20 inside the drill bit 23 extends into the lower end of the high pressure joint 15 and is connected thereto. The lower end of the high pressure line 20 is connected to a nozzle cage 21. A pipe rack 19 passed through by the high pressure channel 20 is disposed in the lower joint 17, so as to fix and righting the high pressure channel 20. The nozzle cage 21 is used for mounting an ultrahigh pressure nozzle 22, which can spray ultrahigh pressure fluid, realize the ultrahigh pressure jet drilling, and improve the rock breaking efficiency and drilling speed. The normal pressure fluid in the annulus between the drive shaft 11 and the high pressure line 10 passes through a pore channel which is opened at the lateral side of the socket 16, then passes through the annular space between the high pressure joint 15 and the lower joint 17, and is spraying from the ordinary nozzle of the drill bit 23, so as to realize downhole drill cuttings cleaning and hydraulic auxiliary rock breaking.

The working principle of the present invention is described as follows: as illustrated in the drawings, the upper joint 1 is integrated with the housing 8, and in their inner space, the filter 2 fits the supercharging cylinder block 6. The supercharging piston 5 mounted in the supercharging cylinder block 6 is in a threaded connection with the high pressure line 10 and fixes it in the drive shaft, and forming an annular space for the normal pressure fluid to pass through at the same time. The top of the supercharging cylinder block 6 is provided with the one-way intake valve 4, and the end of the high pressure line 10 is provided with the one-way drainage valve 13. The working fluid is shunted when passing by the filter 2, wherein only a small part of the working fluid enters the supercharging cylinder block 6 for being supercharged through the via hole on the sidewall of the filter 2, and most of the working fluid flows into the normal pressure passage. The flow passage for the supercharged working fluid, i.e., the high pressure passage includes from top to down: the filter 2, the one-way intake valve 4, the supercharging cylinder block 6, the supercharging piston 5, the high pressure line 10, the one-way drainage valve 13, the high pressure joint 15, the high pressure channel 20 and the high pressure nozzle 22. The supercharged fluid is a very small part of the working fluid. After supercharged, they pass through the high pressure channel 20 connected to the high pressure joint 15 and disposed in the drill bit 23, and then spray from the high pressure bit nozzle 22 of the drill bit, so as to achieve the high pressure jet drilling. Most of the working fluid flows through the normal pressure passage, which is an annular space, being shunted at the filter, and then passes the annular space between the filter 2 and the upper joint 1, the annular passage between the supercharging cylinder block 6 and the upper joint 1, the housing 8 successively, goes through the radial passage of the drive shaft 11, and then enters the annular passage between the drive shaft 11 and the high pressure line 10. After that, they pass through the pore channel on the socket 16, the annular passage between the lower joint 17 and the high pressure joint 15, the pore channel on the pipe rack 19, and finally being sprayed from the ordinary nozzle on the drill bit 23, so as to realize downhole drill cuttings cleaning and hydraulic auxiliary rock breaking.

During the drilling process, the bottom hole assembly (BHA), including the drill bit, will have a strong axial (longitudinal) vibration. When a drilling is carried out with the present invention, the impulse-type underground supercharged jet drilling device of the present invention is mounted between the drill bit 23 and other drill tool, so as to discontinuously supercharge some working fluid for drilling into the high pressure fluid by using the axial (longitudinal) vibration and the pressure energy of the working fluid for drilling. The high pressure working fluid is sprayed through the independent high pressure nozzle 22 on the drill bit to form a high pressure jet, which is very helpful to improve the deep well drilling speed. The generation process of the high pressure jet is as follows: when the drill string moves upwards due to vibration of the drill string or WOB decrease, under the hydraulic pressure of the working fluid for drilling, the upper joint 1 and the housing 8 drive the supercharging cylinder block 6 to move upwards relative to the supercharging piston 5 (tool's extension), as illustrated in FIG. 2. At the same time, a negative pressure is produced in the supercharging cylinder block 6, and the working fluid fully fills the supercharging cylinder block 6 through the one-way intake valve 4. When the drill string moves downwards due to vibration of the drill string or WOB increase, under the impact force or a large WOB, the upper joint 1 and the housing 8 drive the supercharging cylinder block 6 to move downwards relative to the supercharging piston 5 (tool's retraction). The pressure in the supercharging cylinder block 6 rises and shuts down the one-way intake valve 4. Then the supercharging cylinder block 6 continues moving downwards; when the hydraulic pressure in the supercharging cylinder block 6 reaches a predetermined value, the working fluid compels the one-way drainage valve 13 disposed at the lower end of the high pressure line 10 to be opened, and enters the high pressure channel 20 embedded in the drill bit 23, producing a high jet through the high pressure nozzle 22, thereby completing a supercharging process. Afterwards, the drill string continues vibrating or the WOB continues varying, so that the supercharging piston 5 moves up and down relative to the supercharging cylinder block 6 to complete a series of supercharging processes. During the supercharging processes, the supercharging piston 5 moving up and down relative to the supercharging cylinder block 6 is a successive process. The high pressure jet is interrupted when the tool moves upwards for fluid absorption, and being produced when the tool moves downwards for fluid supercharging and discharging. The produced high pressure jet is of the impulse-type rather than being continuous. Meanwhile, during the supercharging process, the working fluid pressure is applied to the upper end face of the drive shaft 11 to compensate the WOB acting on the drill bit. If the WOB is large enough, the upper joint 1 and the housing 8 drive the supercharging cylinder block 6 to move downwards relative to the supercharging piston 5, till the housing 8 contacts with the lower joint 17, thereby transferring the WOB to the drill bit through the upper joint 1, the housing 8 and the lower joint 17.

The basic principle is as follows: when the drill string vibrates up and down or the WOB varies, under an external force, the upper joint 1 and the housing 8 drive the supercharging cylinder block 6 to move up and down relative to the supercharging piston 5 (tool's extension or retraction), thereby intermittently supercharging the working fluid entering the supercharging cylinder block 6. The variation of the external force or the WOB causes the supercharging piston 5 to move up and down relative to the supercharging cylinder block 6.

The above descriptions are just exemplary embodiments of the present invention, rather than limitations to the scope of the present invention. Any equivalent change and modification made by a person skilled in the art without deviating from the conception or principle of the present invention shall fall within the protection scope of the present invention. To be noted, various constituent parts of the present invention are not limited to the above general applications, while one or combinations of the technical features described in the Specification of the present invention may be selected upon the actual demand. Therefore, the present invention certainly covers other combinations and specific applications related to the inventive points of the present application.

What is claimed is:

1. An impulse-type underground supercharged jet drilling method, the method comprising using up and down vibrations of a drill string or weight on a bit variation during a drilling process, so that an upper joint connected to the drill string drives a housing and a supercharging cylinder block disposed therein to move up and down relative to a supercharging piston, and the supercharging piston having a high pressure line connected thereto, and a drive shaft disposed outside the high pressure line making a reciprocally retractable movement relative to the housing, so that some working fluid entering the supercharging cylinder block is intermittently supercharged, and discharged from a high pressure fluid passage disposed in the supercharging piston and the high pressure line, wherein the discharged high pressure working fluid forms a high pressure jet through a nozzle, wherein other working fluid enters a drill bit through a normal pressure fluid passage between the housing, the supercharging cylinder block, the high pressure line, and the drive shaft thereby forming a normal pressure jet, wherein when the drill string moves upwards due to vibration of the drill string or weight on the bit decreases under hydraulic pressure of the working fluid, wherein an upper joint and the housing drive the supercharging cylinder block to move upwards relative to the supercharging piston, so that the drive shaft protrudes from the housing such that at the same time a negative pressure is produced in the supercharging cylinder block and the working fluid enters and fully fills the supercharging cylinder block through a one-way intake valve disposed on the supercharging cylinder block, wherein when the drill string moves downwards due to vibration of the drill string or weight on the bit increases under an impact force or a large weight on the bit, the upper joint and the housing drive the supercharging cylinder block to move downwards relative to the supercharging piston so that the drive shaft retracts into the housing, the pressure in the supercharging cylinder block rises and shuts down the one-way intake valve, and the supercharging cylinder block continues moving downwards, wherein when the hydraulic pressure in the supercharging cylinder block reaches a predetermined value, the supercharged working fluid compels a one-way drainage valve disposed at a lower end of the high pressure line to be opened, enters a high pressure channel embedded in the drill bit, and produces an ultrahigh jet through the nozzle.

2. An impulse-type underground supercharged jet drilling device for implementing the method according to claim 1, comprising:

the housing;

the supercharging cylinder that comprises a supercharging cylinder block and a supercharging piston, wherein the supercharging cylinder block is disposed inside the housing and connected to one end thereof, wherein the first normal pressure fluid passage is formed between the supercharging cylinder block and the housing, wherein one end of the supercharging cylinder block is provided with the one-way intake valve and the other end forms a sliding seal with the supercharging piston;

the drive shaft disposed at the other end of the housing and that only makes retractable movements relative to the housing, wherein the supercharging piston is fixedly connected to the drive shaft;

the high pressure line disposed in the drive shaft, with one end connected to the supercharging piston, and the other end connected to the nozzle; the high pressure line and the supercharging piston are both hollow columns, and their hollow portions construct high pressure fluid passages communicating with each other; a second normal pressure fluid passage is formed between the high pressure line and the drive shaft and communicated with the first normal pressure fluid passage, wherein at an outlet end of the high pressure fluid passages there is disposed the one-way drainage valve to which the nozzle is connected;

wherein the housing is connected to an upper drill tool through an upper joint, wherein one end of the drive shaft protruding outside the housing is fixedly connected to a lower joint, and wherein the lower joint is connected to the drill bit to which the second normal pressure fluid passage is connected.

3. The impulse-type underground supercharged jet drilling device according to claim 2, wherein a sidewall at an upper end of the drive shaft has at least one via hole through which the first and second normal pressure fluid passages are communicated with each other; and wherein the drive shaft comprises a protrusion end capable of protruding outside the housing, and a support end slidably connected to the housing, a sealed sliding connection structure is formed between the support end and the housing.

4. The impulse-type underground supercharged jet drilling device according to claim 3, wherein a drive retainer is secured inside the other end of the housing and a key connection structure is formed between the drive retainer and the protrusion end of the drive shaft.

5. The impulse-type underground supercharged jet drilling device according to claim 4, wherein an inner diameter of the drive retainer is smaller than that of the housing thereby forming a step protruding from an inner wall of the housing, wherein a diameter of the protrusion end of the drive shaft is smaller than that of the support end, wherein an annular stop portion is formed between the protrusion end and the support end, and wherein the stop portion abuts against the step so as to prevent the supercharging piston from dropping out of the supercharging cylinder block.

6. The impulse-type underground supercharged jet drilling device according to claim 5, wherein a run-through fluid passage is formed inside the upper joint, wherein the fluid passage connected to the housing forms a diameter-enlarged accommodation cavity, wherein the supercharging cylinder block has one end protruding outside the housing and located inside the accommodation cavity of the upper joint, a third normal pressure fluid passage is formed between the supercharging cylinder block and an inner wall of the accommodation cavity is a third normal pressure fluid passage that communicates with the first normal pressure fluid passage.

7. The impulse-type underground supercharged jet drilling device according to claim 4, wherein a run-through fluid passage is formed inside the upper joint, wherein the fluid passage connected to the housing forms a diameter-enlarged accommodation cavity, wherein the supercharging cylinder block has one end protruding outside the housing and located inside the accommodation cavity of the upper joint, wherein formed between the supercharging cylinder block and an inner wall of the accommodation cavity is a third normal pressure fluid passage wherein that communicates with the first normal pressure fluid passage.

8. The impulse-type underground supercharged jet drilling device according to claim 3, wherein a run-through fluid passage is formed inside the upper joint, wherein the fluid passage connected to the housing forms a diameter-enlarged accommodation cavity, wherein the supercharging cylinder block has one end protruding outside the housing located inside the accommodation cavity of the upper joint, and wherein formed between the supercharging cylinder block and an inner wall of the accommodation cavity is a third normal pressure fluid passage that communicates with the first normal pressure fluid passage.

9. The impulse-type underground supercharged jet drilling device according to claim 2, wherein a run-through fluid passage is formed inside the upper joint, and the fluid passage connected to the housing forms a diameter-enlarged accommodation cavity, wherein the supercharging cylinder block has one end protruding outside the housing, located inside the accommodation cavity of the upper joint, and a third normal pressure fluid passage is formed between the supercharging cylinder block and an inner wall of the accommodation cavity and communicates with the first normal pressure fluid passage.

10. The impulse-type underground supercharged jet drilling device according to claim 9, wherein a filter is formed as a hollow column with the bottom opens, wherein an opening portion thereof is in a threaded connection with one end of the supercharging cylinder block, wherein the filter is located in the fluid passage of the upper joint, wherein a peripheral side of the filter is provided with a plurality of inlet holes so as to filter the working fluid entering the supercharging cylinder block and wherein a top of the filter is a tapered closed end so as to shunt the working fluid entering the supercharging cylinder block and reduce a flow resistance.

11. The impulse-type underground supercharged jet drilling device according to claim 2, wherein a socket is disposed in the lower joint, wherein a pore channel is opened at a lateral side of the socket to form a fourth normal pressure fluid passage communicating with the second normal pressure fluid passage, wherein the socket has a groove in which a hollow cylindrical high pressure joint is embedded, wherein the one-way drainage valve is disposed in the high pressure joint and a valve core can settle down in the high pressure joint to seal the high pressure fluid passage and wherein the high pressure joint has a lower end that is connected to a high pressure channel that is embedded in the drill bit and connected to the high pressure nozzle.

12. The impulse-type underground supercharged jet drilling device according to claim 2, wherein a run-through fluid passage is formed inside the upper joint, wherein the fluid passage connected to the housing forms a diameter-enlarged accommodation cavity, wherein the supercharging cylinder block has one end protruding outside the housing and located inside the accommodation cavity of the upper joint, and wherein a formed between the supercharging cylinder block and an inner wall of the accommodation cavity is a third normal pressure fluid passage that communicates with the first normal pressure fluid passage.

* * * * *